United States Patent [19]

Ostrowski et al.

[11] 4,207,728

[45] Jun. 17, 1980

[54] EQUIPMENT FOR PNEUMATIC MANUFACTURE OF YARN

[75] Inventors: Jerzy Ostrowski; Piotr Sierputowski, both of Warsaw; Lukasz Turkowski, Sulejowek-Ratajewo; Jerzy Jablkiewicz; Jan Pacholski, both of Łódź; Tadeusz Jędryka, Warsaw, all of Poland

[73] Assignee: Centralny Osrodek Badawczo-Rozwojowy Maszyn Wlokienniczych, Lodz, Poland

[21] Appl. No.: 891,488

[22] Filed: Mar. 29, 1978

Related U.S. Application Data

[63] Continuation of Ser. No. 773,541, Mar. 2, 1977, abandoned.

[30] Foreign Application Priority Data

Mar. 10, 1976 [PL] Poland ..... 187854

[51] Int. Cl.[2] ..... D01H 1/12

[52] U.S. Cl. ..... 57/58.89

[58] Field of Search ..... 57/34 B, 58.89, 58.95, 57/157 F

[56] References Cited

U.S. PATENT DOCUMENTS

| | | | |
|---|---|---|---|
| 3,577,720 | 5/1971 | Zax et al. | 57/58.89 |
| 3,851,455 | 12/1974 | Jozwicki et al. | 57/160 X |
| 3,994,120 | 11/1976 | Radom et al. | 57/58.89 |

FOREIGN PATENT DOCUMENTS

| | | | |
|---|---|---|---|
| 1115163 | 10/1961 | Fed. Rep. of Germany | 57/58.89 |
| 1381582 | 1/1975 | United Kingdom | 57/58.89 |
| 244160 | 9/1969 | U.S.S.R. | 57/58.89 |

*Primary Examiner*—Donald Watkins

*Attorney, Agent, or Firm*—Haseltine, Lake & Waters

[57] ABSTRACT

The manufacture of yarn in a non-rotational spinning chamber, using the air jets directed by a system of passages, the air flow stream rotating quickly becomes restricted to the whirl core, and swirled air flow is forced along the spinning chamber walls. The cylindrical, non-rotational chamber has one closed end and an insert incorporating a yarn discharge channel. Also provided as part of the chamber are peripherally disposed air supply ducts and a fiber delivery channel. The chamber is provided with a cylindrical element and air guides disposed under a fiber ring arranged at the chamber outlet.

1 Claim, 1 Drawing Figure

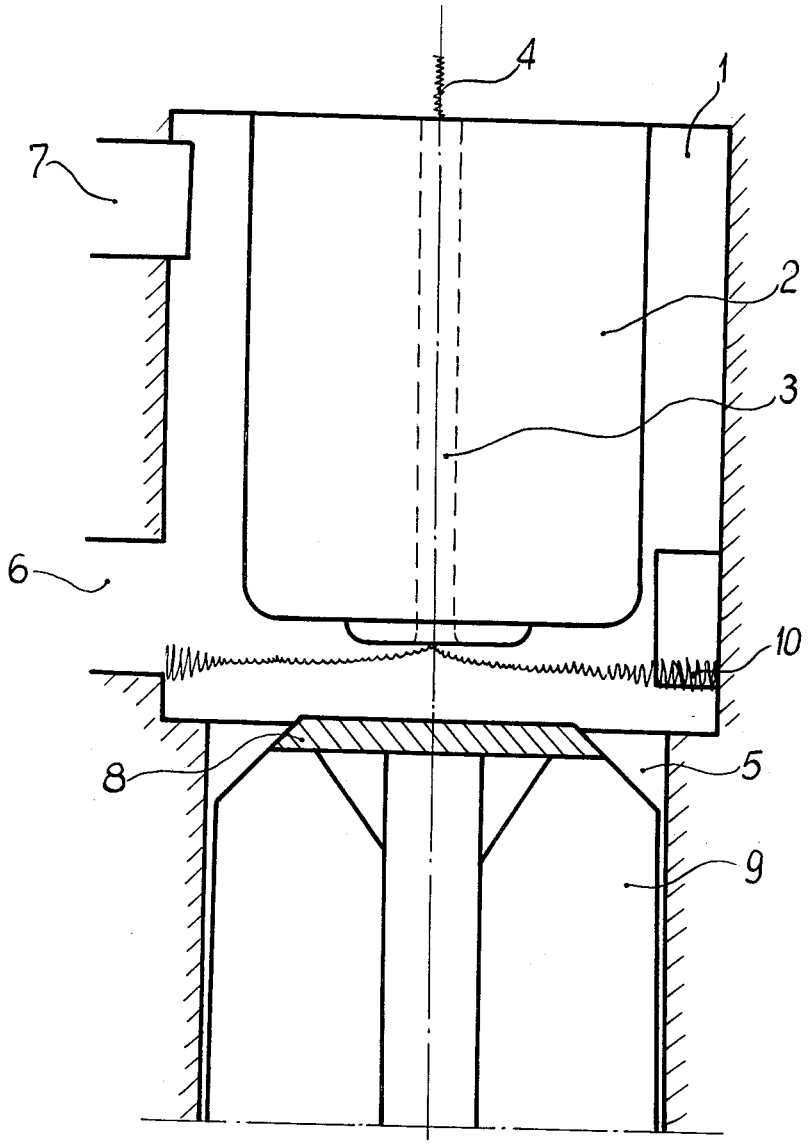
4
1
7
2
3
6
10
8
5
9

EQUIPMENT FOR PNEUMATIC MANUFACTURE OF YARN

More particularly the present application is a Rule 60 Continuation Application of U.S. Ser. No. 773,541, filed Mar. 2, 1977, entitled NEW METHOD FOR PNEUMATIC MANUFACTURE OF YARN AND THE RELEVANT EQUIPMENT OF USE THE METHOD, now abandoned.

BACKGROUND OF THE INVENTION

This invention is directed to a method and apparatus for pneumatic manufacture of yarn from natural- or synthetic fibers.

The hitherto known process of pneumatic spinning, consists of introducing fibers into a non-rotational spinning chamber wherein jets of air acting on the fibers cause the fibers to form a whirling fiberous ring resulting in a peripheral velocity in the section where forming and twisting of yarn takes place. The fibers thus formed are gathered from said whirling ring and discharged from the chamber.

Prior art equipment for pneumatic spinning of yarn consists of a cylindrical, non-rotatable chamber into which fibers are introduced and placed into rotational motion by means of air jets introduced into the chamber through the ducts arranged in the chamber periphery. The produced yarn is discharged through a channel provided in a cylindrical insert inside the chamber.

The spinning process rate according to the prior art is proportional to the peripheral velocities within the zone forming the fiber wirl ring. The formation of a peripheral velocity field is counteracted by the whirl core being produced in the chamber center line, whereby the rotational field becomes intensified within the said whirl core, thus preventing further rising of peripheral velocities at the chamber walls.

SUMMARY OF THE INVENTION

The principal features of the present invention are directed to a method and apparatus for pneumatic manufacture of yarn inside a non-rotational spinning chamber employing air jets for whirling the fibers introduced into the chamber. The flow of whirling air is decreased to the whirl core and the air flow is urged to travel along the spinning chamber walls. Also within the scope of the present invention is the use of a structure which is in cooperative relationship to the spinning chamber in which a cylindrical element means is disposed within the chamber beneath a fiber ring means and air guide means are positioned in the chamber outlet to act upon the air stream in cooperation with the cylindrical element means.

The main object of the present invention is to overcome the defects of the prior art.

Another object of the present invention is to limit the rotational air stream velocity by urging it to pass along the chamber walls and in turn increase the spinning rate by limiting the swirling air flow in the whirl core.

Another object of the present invention is to recover some of the air jet kinetic energy and converting it into potential energy.

Other objects and advantages of the present invention will be more readily understood with reference to the accompanying specification, claims and drawing.

BRIEF DESCRIPTION OF THE DRAWINGS

The single FIGURE of the present invention illustrates a longitudinal sectional view of the invention.

PREFERRED EMBODIMENT

The present invention is concerned with a method and apparatus for controlling the whirling air streams and restricting such streams to the whirl core, the swirled air being forced to pass longwise the chamber walls.

The apparatus according to the invention being embodied in form of a cylindrical, non-rotational spinning chamber for directing the air flow along the said chamber walls. The structure for accomplishing the aforementioned being located beneath the whirling fiber ring and air guides arranged under the structure at the chamber outlet.

With the air flow forced along the chamber walls, the swirling air flow within the said whirl core becomes weakened, thus increasing the yarn spinning rate. Furthermore, with the air flow guides arranged in the chamber outlet, some portion of the air jet kinetic energy can be recovered.

Accordingly, the single FIGURE, a cylindrical spinning chamber 1 being closed at one end with the cylindrical insert 2, is provided with a concentric channel 3 for discharging the yarn 4 at one end, and communicates with a vacuum source, via the suction duct 5 at the opposite end. The chamber 1 is provided with supply air ducts 6 disposed about its periphery and are located in any section of the chamber, as well as a fiber delivery channel 7 on its upper portion. A cylindrical element 8 such as a disk is provided inside the chamber 1, beneath the yarn spinning level. Air suction side the guides 9 arranged beneath cylindrical element 8 enables the kinetic energy to be partially recovered and converted into the potential energy.

To start spinning, a length of a yarn is introduced into the chamber 1, via the channel 3, and after attaining rotational motion therein, this length will gather fibers from the whirling ring 10 to twist them, whereupon the ready yarn 4 becomes discharged out of the chamber.

During operation air is sucked into chamber 1, causing it to whirl inside the chamber. The fibers in the chamber 1 are caused to rotate under the influence of the air jets and produce a rotating fiber ring 10 rotating over the chamber 1 inner walls. As the air jets meet the element 8, which restricts the swirling air flow from the chamber walls towards the whirl core, the air stream moving with high peripheral velocity passes along the chamber walls, thus reducing the whirl effect.

While we have illustrated a preferred embodiment of the invention, many modifications may be made without departing from the spirit and scope of the invention, and we do not wish to be limited to the precise details of construction set forth but desire to avail ourselves of all changes within the scope of the appended claims.

We claim:

1. An apparatus for pneumatic manufacture of yarn, comprising: a stationary cylindrical non-rotational spinning chamber, said chamber being closed with a separator at one end; said separator having a yarn discharge channel and, communicating at its other end with a vacuum source; peripheral ducts for supplying air; a fibre delivery channel (7) at the periphery of said chamber; cylindrical insert means formed of a cylindrical element (8) located inside the spinning chamber (1) beneath a zone where a ring (10) of whirling fibres is formed and being adapted to restrict swirling air flow; air guides (9) disposed in the chamber (1) outlet beneath the said element (8), said air guides (9) being adapted to alter air flows in an axial direction.

* * * * *